United States Patent [19]

Wright

[11] 4,009,824

[45] Mar. 1, 1977

[54] SWINGING BUCKET CENTRIFUGE ROTOR

[75] Inventor: Herschel E. Wright, Santa Clara, Calif.

[73] Assignee: Beckman Instruments, Inc., Fullerton, Calif.

[22] Filed: Dec. 31, 1975

[21] Appl. No.: 645,813

[52] U.S. Cl. ..... 233/26

[51] Int. Cl.[2] ..... B04B 9/12

[58] Field of Search ..... 233/26

[56] References Cited

UNITED STATES PATENTS

| | | | |
|---|---|---|---|
| 1,991,925 | 2/1935 | Garver | 233/26 |
| 3,722,791 | 3/1973 | Wright | 233/26 |

FOREIGN PATENTS OR APPLICATIONS

| | | | |
|---|---|---|---|
| 527,712 | 10/1940 | United Kingdom | 233/26 |
| 737,761 | 9/1955 | United Kingdom | 233/26 |

*Primary Examiner*—George H. Krizmanich

*Attorney, Agent, or Firm*—R. J. Steinmeyer; F. L. Mehlhoff

[57] ABSTRACT

In a swinging bucket centrifuge rotor of the type including a core with outwardly extending support arms having removable trunnion pins for supporting a plurality of bucket assemblies, each bucket assembly including a rotor bucket support having a pocket on opposite sides thereof for receiving the extremities of adjacent pins, there is disclosed an improvement wherein each of the arms has only a single hole formed in the outer end thereof, perpendicular to the longitudinal axis thereof, for receipt of a single trunnion pin including a central portion and acutely oriented opposite extremities, the opposite extremities of each trunnion pin extending outwardly from the arms towards and coaxial with the outwardly extending extremities of the pins of adjacent arms, and wherein the pockets in each support are cut into the sides thereof at an acute angle relative to the axis thereof.

14 Claims, 5 Drawing Figures

SWINGING BUCKET CENTRIFUGE ROTOR

BACKGROUND OF THE INVENTION

1. Field of the Invention

The present invention relates to a swinging bucket centrifuge rotor and, more particularly, to a centrifuge rotor providing higher rotor performance, greater rotor strength, and a decreased manufacturing cost.

2. Description of the Prior Art

Swinging bucket-type centrifuge rotors including a plurality of rotor buckets supported on trunnion pins disposed at the ends of outwardly extending support arms are well known in the art. Such rotors have included both integral and separable or removable trunnion pins. Rotors with integral trunnions are relatively expensive to manufacture. Prior rotors with removable trunnion pins have generally necessitated the separation of pairs of pins mounted at the end of each arm to permit assembly of the pins into the arms, such as by press fitting or threading the pins into the arms. Such assemblies have been relatively complicated and expensive.

In my prior U.S. Pat. No. 3,722,791, issued Mar. 27, 1973, for Centrifuge Rotor With Removable Trunnion Pins, there is disclosed and claimed an improved centrifuge rotor including outwardly extending arms which accommodate removable trunnion pins which cooperate with one another under centrifugal forces. Such centrifuge rotor represents a substantial improvement in the state of the art. It is the primary object of the present invention to improve the state of the art still further.

The power required to drive and cool a centrifuge rotor in an atmospheric environment increases exponentially with diameter. It is therefore very important that a given volume of sample be carried in the smallest possible diametral envelope. Previous designs, including the design of my prior patent, have used separate pins for each of the pivot surfaces which require significant circumferential spacing of the pins to prevent interference of the holes in the support arms. This circumferential spacing increases the total rotor diameter. Such designs also require a large number of machining operations.

Still further, previous designs, including the design of my prior patent, use rotor bucket supports having cavities or pockets therein which are cut parallel to the axis thereof. This maximizes the amount of material removed, which greatly reduces the beam strength of the support as it is taken from a point which is the furthest from the neutral axis of the beam. Thus, prior rotor bucket supports have had insufficient strength for a variety of applications.

SUMMARY OF THE INVENTION

According to the present invention, there is provided a centrifuge rotor having higher rotor performance and greater rotor strength than attainable heretofore. Furthermore, this improvement in performance and strength is accompanied by a decrease in cost as a result of a reduction in machining operations. The present design of the trunnion pins optimizes the space required for their function, thereby minimizing the total rotor diameter for a given number of buckets. With the present design, the number of precision holes which must be drilled is reduced by half, thereby significantly decreasing the manufacturing cost. Furthermore, with the present design, the pocket in the rotor bucket support is cut in a manner which minimizes the removal of material and removes the material along a line which is almost centered on the neutral axis of the rotor bucket support, making the present design much stronger than previous designs.

Briefly, the present centrifuge rotor comprises a core for mounting the rotor on a drive shaft for rotating the rotor about its axis of rotation, a plurality of spaced arms extending radially outward from the axis of rotation, each of the arms having only a single hole formed in the outer end thereof, perpendicular to the longitudinal axis thereof, and a trunnion pin disposed in each of the holes, each trunnion pin including a central portion and acutely oriented opposite extremities, the opposite extremities of each trunnion pin extending outwardly from the arms towards and coaxial with the outwardly extending extremities of the pins of adjacent arms to form trunnions for supporting bucket assemblies. The centrifuge rotor further includes a bucket assembly positioned between each pair of adjacent arms, the bucket assembly including a support having a pocket on opposite sides thereof for receiving the facing extremities of adjacent pins for supporting the bucket assembly, the pockets being cut into the support at an acute angle relative to the axis thereof to minimize the material removed in forming the pockets and to increase the strength of the bucket assembly.

OBJECTS

It is therefore an object of the present invention to provide a swinging bucket centrifuge rotor.

It is a further object of the present invention to provide a swinging bucket centrifuge rotor having increased rotor performance.

It is a still further object of the present invention to provide a swinging bucket centrifuge rotor having greater rotor strength.

It is another object of the present invention to provide a swinging bucket centrifuge rotor in which cost is decreased as a result of the reduction of machining operations.

It is still another object of the present invention to provide a swinging bucket rotor which maximizes the volume of sample which amy be carried in a given diametral envelope.

Another object of the present invention is the provision of a swinging bucket centrifuge rotor of the type having a plurality of outwardly extending support arms having removable trunnion pins for supporting a bucket assembly which significantly reduces the number of trunnion pins and holes which must be drilled therefor.

Still other objects, features, and attendant advantages of the present invention will become apparent to those skilled in the art from a reading of the following detailed description of the preferred embodiments constructed in accordance therewith, taken in conjunction with the accompanying drawings wherein the numerals designate like or corresponding parts in the several figures and wherein:

DESCRIPTION OF THE PREFERRED EMBODIMENTS

Figure 1:
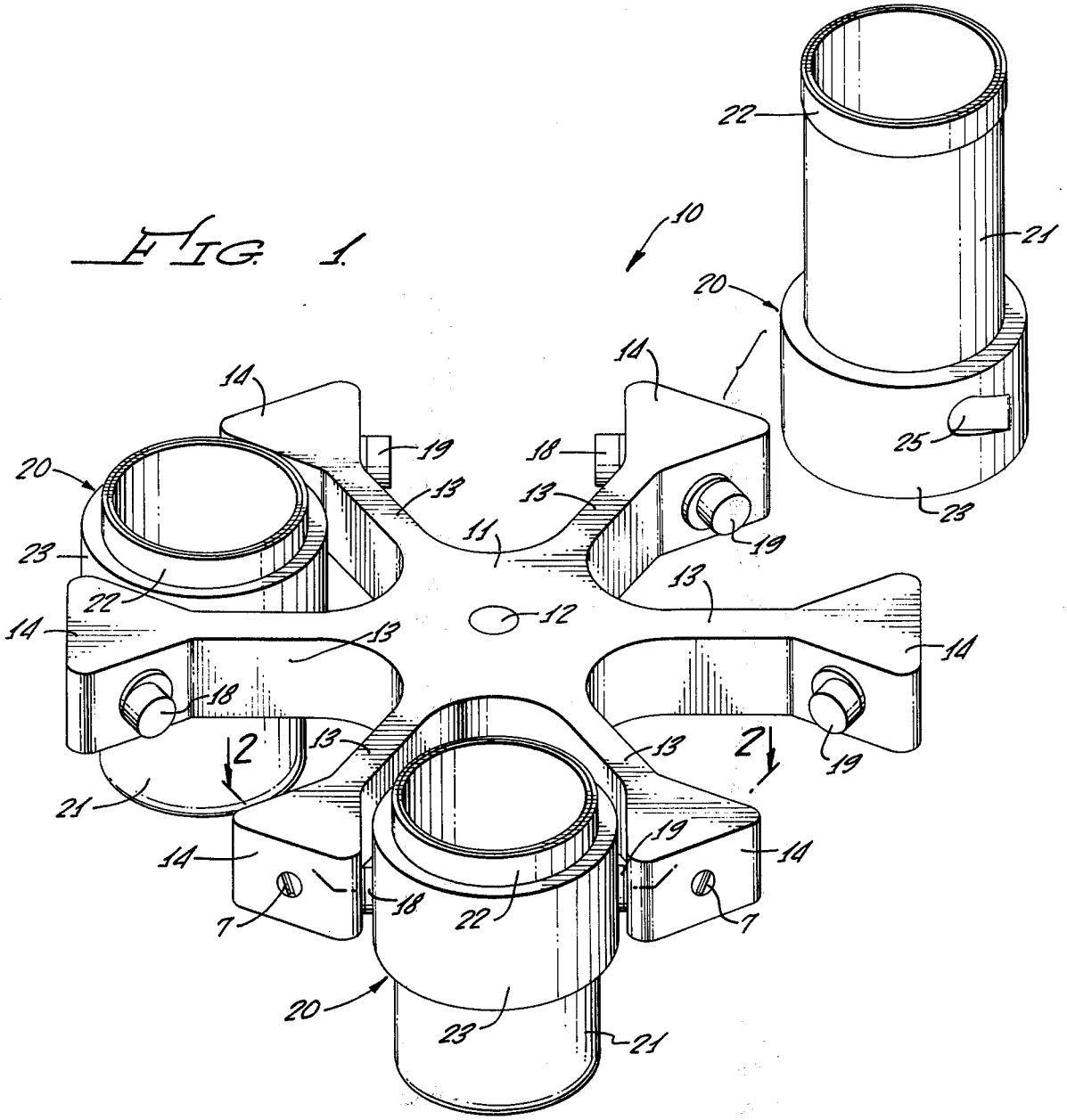
FIG. 1 is a perspective view of a first embodiment of swinging bucket centrifuge rotor constructed in accordance with the teachings of the present invention.
Figure 4:
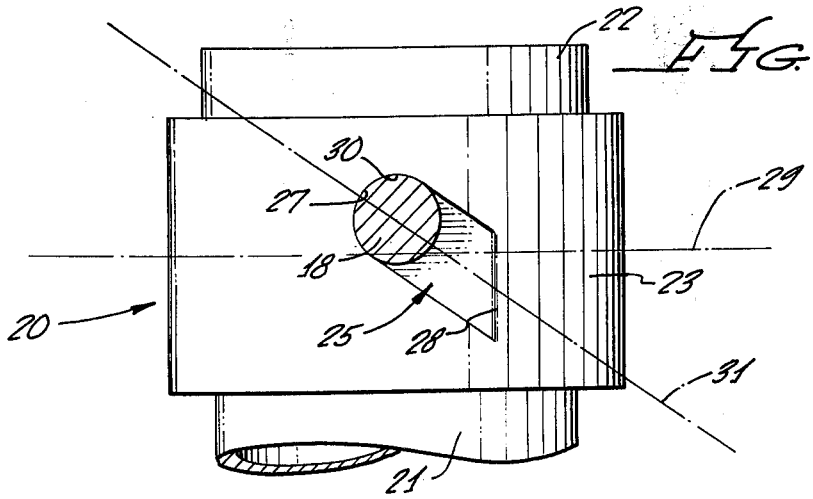
FIGS. 2, 3 and 4 are sectional views taken along the lines 2—2, 3—3 and 4—4 in FIGS. 1, 2 and 3, respectively.
Figure 2:
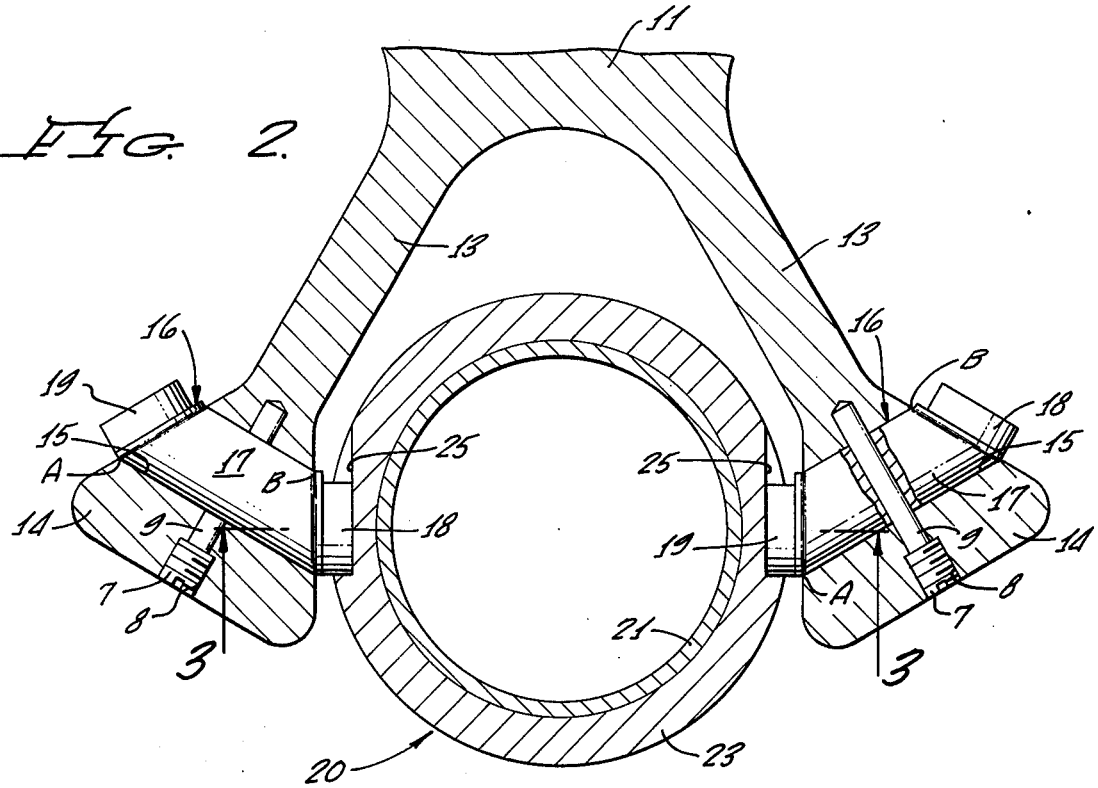
Figure 3:
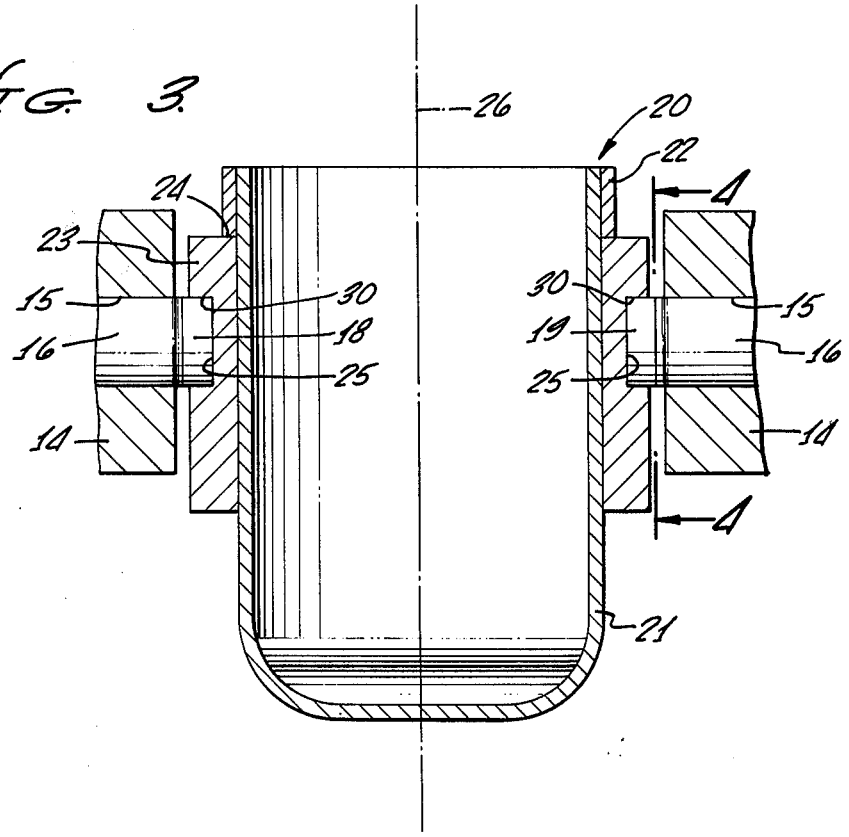

Referring now to FIGS. 1–4, a first centrifuge rotor, generally designated 10, includes a yoke or core 11 which is provided with a central hole 12 for mounting rotor 10 on an associated drive shaft (not shown) for rotating rotor 10 about its axis of rotation. Rotor 10 is provided with a plurality of identical, spaced, support arms 13 which extend radially outward from the axis of rotor 10. Each of arms 13 terminates at its outer extremity is an enlarged trunnion pin support portion 14.

Extending through each enlarged portion 14 of each support arm 13 is a single hole 15 which is drilled through arms 13 perpendicular to the longitudinal axes thereof. All of holes 15 are formed with their center lines lying in a plane which is perpendicular to the axis of rotation of rotor 10. A single trunnion pin 16 is disposed in each of holes 15. All of trunnion pins 16 are identical and each includes a central portion 17 and acutely oriented opposite extremities 18 and 19 which extend outwardly from enlarged portions 14 of arms 13 towards and coaxial with the outwardly extending extremities of the pins 16 of adjacent arms 13 to form trunnions for supporting bucket assemblies, generally designated 20, only some of which have been shown. In other words, each trunnion pin extremity 18 faces, extends toward, and is coaxial with the extremity 19 of an adjacent trunnion pin 16.

Each trunnion pin 16 is held in position in its associated arm 13 by a dowel 9 which extends into each of arms 13, from the outer end thereof, along the longitudinal axis thereof, through hole 15 and the trunnion pin 16 therein. The end of each arm 13 is provided with an internally threaded hole 8 through which dowels 9 pass, holes 8 receiving a set screw or other threaded member 7 to prevent the removal of dowels 9.

Each bucket assembly 20 includes a generally cylindrical, open-ended, thin-walled bucket 21 having a ring 22 welded to the outer surface thereof, adjacent the open upper end thereof. Bucket 21 is positioned within a rotor bucket support sleeve 23 having an inside diameter which is approximately equal to the outside diameter of bucket 21 but which is less than the outside diameter of ring 22. Thus, ring 22 suspends bucket 21 from sleeve 23, at interface 24. Each sleeve 23 has a pocket, cavity, or slot 25 on opposite sides thereof for receiving the facing extremities 18 and 19 of adjacent trunnion pins 16 for supporting sleeve 23 and bucket 21 between arms 13. Each pocket 25 is positioned at an acute angle relative to the axis 26 of sleeve 23 and has a closed end 27 and an open end 28 which permits sleeve 23 to be slid onto extremities 18 and 19 of adjacent trunnion pins 16. Under the influence of induced angular velocity, buckets 21 and sleeves 23 rotate around extremities 18 and 19 to a horizontal position for sedimentation of the samples in buckets 21.

The power required to drive and cool a centrifuge rotor in an atmospheric environment increases exponentially with diameter. It is therefore very important that a given volume of sample be carried in the smallest possible diametral envelope. Previous designs of trunnion pins have used separate pins for each pivot surface, which requires significant circumferential spacing of the pins to prevent interference of the holes. This circumferential spacing increases the total rotor diameter. For example, in my prior patent, four arms are used to support four bucket assemblies.

Centrifuge rotor 10 optimizes the space required for each trunnion pin 16. In rotor 10, six support arms 13 may be used to support six bucket assemblies 20 which are carried in the smallest possible diametral envelope possible. With such a design, the minimum separation between adjacent bucket assemblies 20 is determined by the minimum distance between points A and B which must resist torque caused by asymmetrical bucket loading. More specifically, if the load in each bucket assembly 20 is not identical, there will be greater force on one extremity of trunnion pin 16 than on the other extremity thereof during operation of rotor 10. This asymmetrical force creates a torque on trunnion pin 16 which must be resisted by enlarged portion 14 of arm 13, the ability to resist being determined by the distance between points A and B. Once this minimum distance is established, the six bucket assemblies 20 may be arranged in the smallest possible diametral envelope.

In rotor 10, the number of precision holes 15 which must be drilled has been reduced by half, since each trunnion pin 16 provides two pivot surfaces, on extremeities 18 and 19. Extremities 18 and 19 are positioned at an angle of 30° relative to central portion 17 of trunnion pin 16.

According to the present invention, each sleeve 23 acts as a beam having a neutral axis 29, the beam being supported at two points 30 at the closed ends 27 of pockets 25 and loaded around its upper surface at interface 24. Previous designs have used a pocket which was cut parallel to axis 26, perpendicular to neutral axis 29. This maximizes the amount of material removed and greatly reduces the beam strength of the sleeve. According to the present invention, pockets 25 are formed by cutting the outer surface of sleeve 23 along a line 31 which is positioned at an acute angle in excess of 45° relative to axis 26. In this manner, the amount of material removed decreases from closed end 27 to open end 28 of pocket 25 and, still further, such material removal is almost centered on neutral axis 29 of sleeve 23. Thus, rotor 10 is much stronger than designs utilized heretofore.

Figure 5:
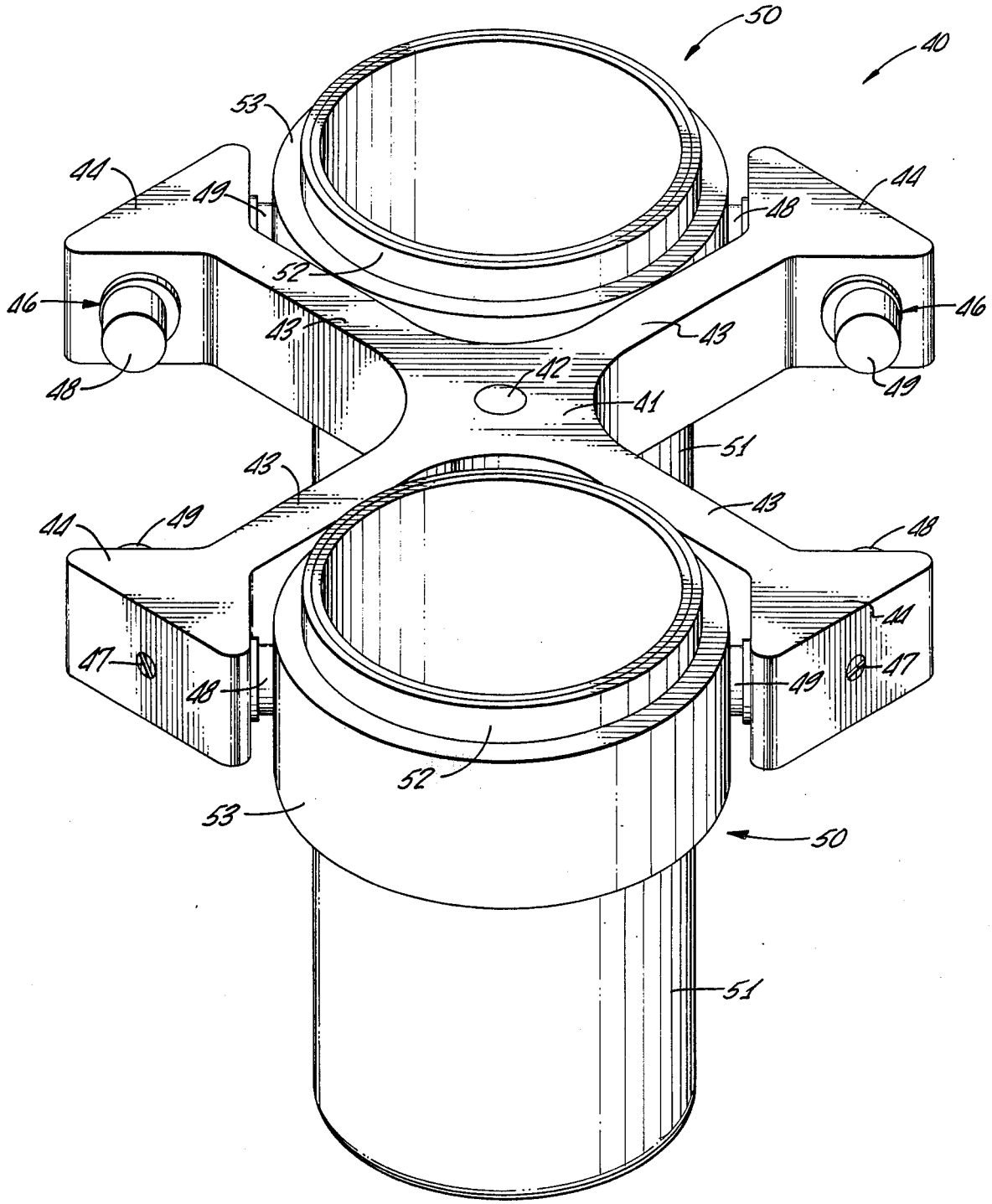
FIG. 5 is a perspective view of a second embodiment of swinging bucket centrifuge rotor constructed in accordance with the teachings of the present invention.

Referring now to FIG. 5, there is shown a second embodiment of centrifuge rotor, generally designated 40, constructed in accordance with the teachings of the present invention. That is, under some circumstances, the use of six support arms and six bucket assemblies results in bucket assemblies having insufficient carrying capacity. Under such circumstances, it is desirable to increase the size of each bucket without increasing the overall diameter of the rotor and this is accomplished, most efficiently, by the use of a rotor having four arms and four bucket assemblies. Thus, centrifuge rotor 40 is essentially identical to centrifuge rotor 10 except that the number of support arms has been reduced from six to four and each bucket assembly has been increased in size.

More specifically, rotor 40 includes a yoke or core 41 which is provided with a central hole 42 for mountig rotor 40 on an associated drive shaft (not shown) for rotating rotor 40 about its axis of rotation. Rotor 40 is provided with a plurality of identical, spaced, support arms 43 which extend radially outward from the axis of rotor 40. Each of arms 43 terminates at its outer extremity in an enlarged trunnion pin support portion 44.

As was the case with trunnion pin support portions 14 of rotor 10, extending through each enlarged portion 44 of each support arm 43 of rotor 40 is a single hole which is drilled throught arms 43 perpendicular to the longitudinal axes thereof. All of such holes are formed with their center lines lying in a plane which is perpendicular to the axis of rotation of rotor 40. A single trunnion pin 46 is disposed in each of the holes. All of trunnion pins 46 are identical and each includes acutely oriented opposite extremities 48 and 49 which extend outwardly from enlarged portions 44 of arms 43 towards and coaxial with the outwardly extending extremities of the pins 46 of adjacent arms 43 to form trunnions for supporting bucket assemblies, generally designated 50, only some of which have been shown. Extremities 48 and 49 are positioned at an acute angle of 45° relative to the central portions of trunnion pins 46.

Each trunnion pin 46 is held in position in its associated arm 43 in the manner described previously with regard to rotor 10 by means including a dowel (not shown) and a set screw 47. Each bucket assembly 50 is identical, except in size, to bucket assemblies 20 and includes a generally cylindrical, open-ended, thin-walled bucket 51, a ring 52, and a rotor bucket support sleeve 53. Assemblies 50 are supported by trunnion pins 46 in the manner described previously with regard to assemblies 20.

It can therefore be seen that according to the present invention, there is provided centrifuge rotors having higher rotor performance and greater rotor strength than attainable heretofore. Furthermore, this improvement in performance and strength is accompanied by a decrease in cost as a result of a reduction in machining operations. The present designs of trunnion pins 16 and 46 optimizes the space required for their function, thereby minimizing the total rotor diameter for a given number of buckets. With the present designs, the number of precision holes which must be drilled is reduced by half, thereby significantly decreasing manufacturing costs. Furthermore, with the present designs, the pockets in the rotor bucket support sleeves are cut in a manner which minimizes the removal of material and removes the material along a line which is almost centered on the neutral axis of the support sleeves, making the present designs much stronger than previous designs.

While the invention has been described with respect to the preferred physical embodiments constructed in accordance therewith, it will be apparent to those skilled in the art that various modifications and improvements may be made without departing from the scope and spirit of the invention. For example, while centrifuge rotors including four and six arms equally spaced around a core have been disclosed, it will be obvious to those skilled in the art that less or more arms may be used if desired. Accordingly, it is to be understood that the invention is not to be limited by the specific illustrative embodiments, but only by the scope of the appended claims.

I claim:

1. A centrifuge rotor comprising:

a core for mounting the rotor on a drive shaft for rotating the rotor about its axis of rotation;

a plurality of spaced arms extending radially outward from said axis of rotation, each of said arms having only a single hole formed in the outer end thereof, perpendicular to the longitudinal axis thereof; and a trunnion pin disposed in each of said holes, each trunnion pin including a central portion and acutely oriented opposite extremities, said opposite extremities of each trunnion pin extending outwardly from said arms towards and coaxial with the outwardly extending extremities of the pins of adjacent arms to form trunnions for supporting bucket assemblies.

2. A centrifuge rotor according to claim 1 further comprising:

means for locking said trunnion pins in said holes.

3. A centrifuge rotor according to claim 2 wherein said locking means comprises:

a dowel extending into each of said arms, along the longitudinal axis thereof, through said hole and said trunnion pin therein.

4. A centrifuge rotor according to claim 1 including six arms equally spaced around said core.

5. A centrifuge rotor according to claim 4 wherein said extremities of each trunnion pin are oriented at an angle of 30° relative to said central portion thereof.

6. A centrifuge rotor according to claim 1 including four arms equally spaced around said core.

7. A centrifuge rotor according to claim 6 wherein said extremities of each trunnion pin or oriented at an angle of 45° relative to said central portion thereof.

8. A centrifuge rotor according to claim 1 further comprising:

a plurality of bucket assemblies, each bucket assembly including a support having a pocket on opposite sides thereof for receiving the facing extremities of adjacent pins for supporting said bucket assembly, said pockets being positioned at an acute angle relative to the axis of said support and being arcuate relative to the axis of said bucket assembly.

9. A centrifuge rotor according to claim 8 wherein each of said pockets has a closed end and an open end and said pockets extend in the same directions on opposite sides of said support.

10. A centrifuge rotor according to claim 9 wherein the depth of each of said pockets decreases from said closed end to said open end thereof.

11. A centrifuge rotor according to claim 10 where said pockets are positioned at an acute angle which is greater than 45° relative to said axis of said support.

12. In a centrifuge rotor including a core for mounting the rotor on a drive shaft for rotating the rotor about its axis of rotation, a plurality of spaced arms extending radially outward from said axis of rotation, and a trunnion pin connected to the outer end of each arm, at least one end of each trunnion pin extending outwardly from said arms towards and coaxial with the outwardly extending extremity of an adjacent trunnion pin to form a trunnion for supporting a bucket assembly, and a bucket assembly positioned between each pair of adjacent arms, each bucket assembly having a pocket on opposite sides thereof for receiving the facing extremities of adjacent pins for supporting said bucket assembly, the improvement wherein said pockets are positioned at an acute angle relative to the axis of said bucket assembly.

13. In a centrifuge rotor according to claim 11 wherein said bucket assembly includes a support sleeve, said pockets being positioned in said sleeve, on opposite sides thereof, said pockets having a closed end and an open end, the improvement wherein said pockets extend in the same directions on opposite sides of said sleeve and wherein the depth of each of said pockets decreases from said closed end to said open end thereof.

14. In a centrifuge rotor according to claim 13, the improvement wherein said pockets are positioned at an acute angle which is greater than 45° relative to the axis of said sleeve.

* * * * *